United States Patent [19]

Flood

[11] Patent Number: 5,033,781

[45] Date of Patent: Jul. 23, 1991

[54] SCOOP FOR REMOVING ANIMAL DROPPINGS FROM THE GROUND

[76] Inventor: Thomas D. Flood, 3616 Ordway St., NW., Washington, D.C. 20016

[21] Appl. No.: 520,402

[22] Filed: May 8, 1990

[51] Int. Cl.[5] ..... A01K 29/00; A47L 13/52; E01H 1/12

[52] U.S. Cl. ..... 294/1.4; 15/257.6; 15/257.7; 294/53.5

[58] Field of Search ..... 294/1.3–1.5, 294/19.1, 50.9, 53.5, 55; 15/104.8, 257.1, 257.2, 257.4, 257.6, 257.7; 16/110.5; 56/400.12

[56] References Cited

U.S. PATENT DOCUMENTS

| | | | |
|---|---|---|---|
| 497,401 | 5/1893 | Bates | 15/257.7 |
| 788,754 | 5/1905 | Corner et al. | 15/257.7 |
| 1,645,806 | 10/1927 | Fries | 15/257.6 X |
| 3,827,098 | 8/1974 | Sanderson | 15/257.4 X |
| 3,868,135 | 2/1975 | Magliaro | 294/1.5 |
| 3,910,619 | 10/1975 | Schmieler | 15/257.6 X |
| 4,005,892 | 2/1977 | Williams | 294/1.4 |
| 4,143,899 | 3/1979 | Wetherall et al. | 294/1.4 X |
| 4,240,656 | 12/1980 | Eiffinger | 294/1.4 |
| 4,316,627 | 2/1982 | Solypa | 294/1.4 |

*Primary Examiner*—Johnny D. Cherry
*Attorney, Agent, or Firm*—Brady, O'Boyle & Gates

[57] ABSTRACT

A scoop for removing animal droppings from the ground, wherein a receptacle is pivotally connected to the lower end of an elongated shaft. A closure is secured on the shaft above the receptacle. A sleeve is slidably mounted on the shaft, and a link is connected between the receptacle and the sleeve so that by pushing the sleeve downwardly on the shaft the receptacle is pivoted away from the closure to the open ground engaging position, and by pulling upwardly on the sleeve the receptacle is pivoted in a direction toward and beneath the closure to the closed position. A removable handle is connected to the upper end portion of the elongated shaft to provide a chamber containing an element for manually pushing the droppings into the open receptacle.

17 Claims, 3 Drawing Sheets

FIG. 1
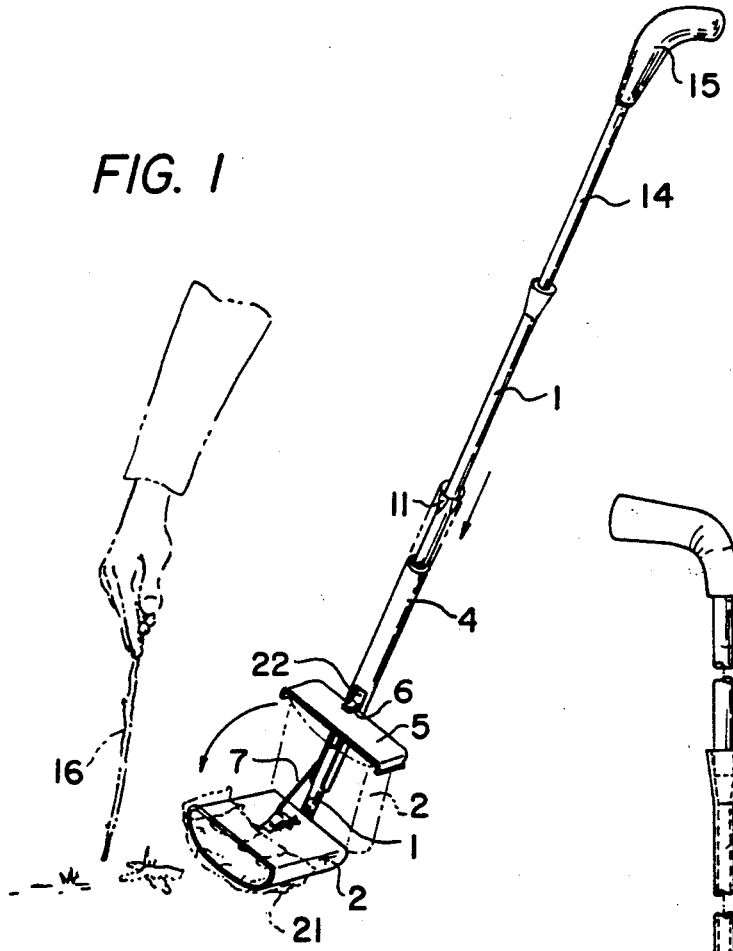
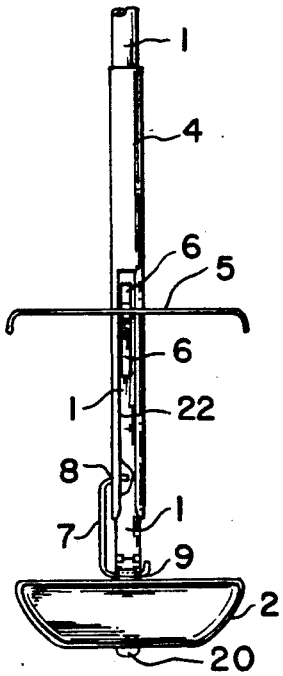
FIG. 3
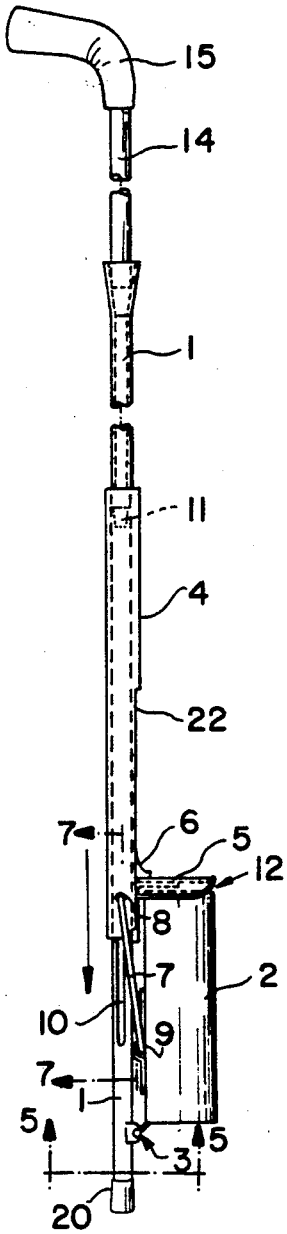
FIG. 2

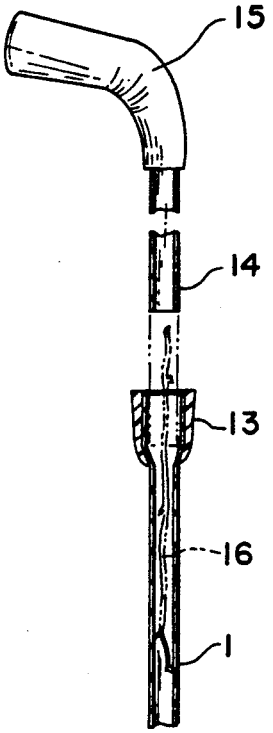
FIG. 4
FIG. 5
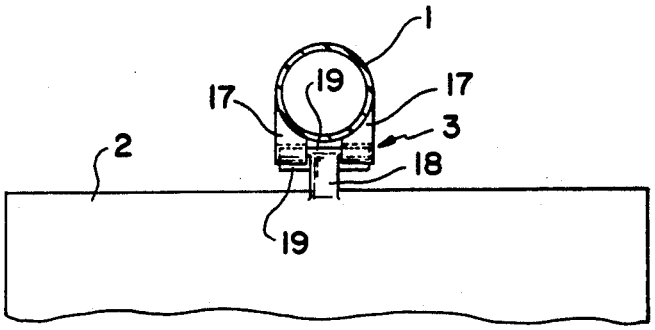
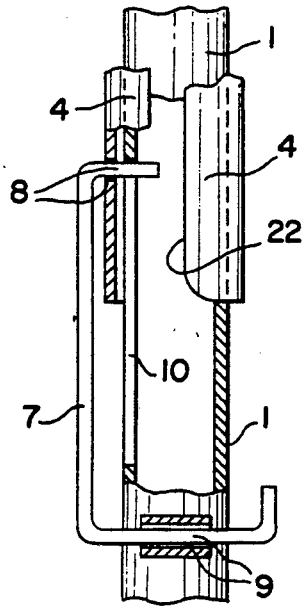
FIG. 7
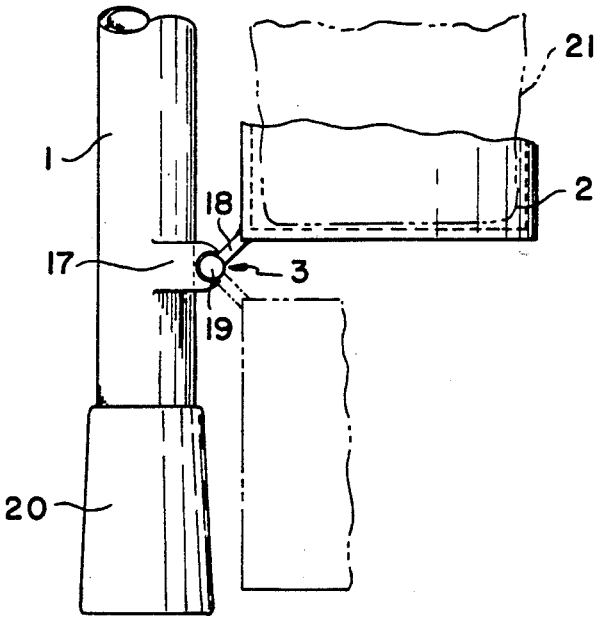
FIG. 6

SCOOP FOR REMOVING ANIMAL DROPPINGS FROM THE GROUND

BACKGROUND OF THE INVENTION

In various urban areas, legislation has been passed requiring dog owners to clean up the solid waste that their pets deposit on public sidewalks, grass and curbs. Failure to remove the deposited waste subjects the owner to a fine.

Various devices have been proposed to facilitate the removal of the waste, and these devices have ranged from a simple short handled scoop or shovel to a more complicated device wherein a scoop and closure are operatively connected to the lower end of a long handle or shaft and manipulated between an open and closed position.

The latter type of device is disclosed in U.S. Pat. No. 3,868,135, dated Feb. 25, 1975, wherein a receptacle is mounted on the lower end of an elongated handle, and a closure is pivotally connected to the receptacle. A cable for moving the closure relative to the receptacle has one end connected to the closure and extends upwardly through the elongated handle. The upper end of the cable is provided with a knob which is grasped by the dog walker, whereby the cable can be pulled upwardly to open the closure and then pushed downwardly to move the closure to the closed position relative to the receptacle.

While the device disclosed in the above-mentioned patent is satisfactory for its intended purpose, there are some inherent disadvantages in its construction. For instance, the portion of the closure operating cable connected to the closure extends outwardly from the lower end of the elongated handle, whereby that portion of the cable is exposed to the ground and can become soiled. Furthermore, the long cable provides a somewhat flexible connection between the operating handle and closure, whereby a positive actuation of the closure becomes difficult after continued use.

SUMMARY OF THE INVENTION

After considerable research and experimentation, the scoop of the present invention has been devised to overcome the disadvantages experienced with the above-mentioned scoop device and comprises, essentially, an elongated shaft having a receptacle pivotally connected to the lower end portion thereof, and a closure fixedly mounted on the shaft in spaced relation to the top of the receptacle when it is in a closed position in alignment with the shaft. A sleeve is slidably mounted on the shaft. A link is provided and has one end pivotally connected to the lower end of the sleeve, and the opposite end pivotally connected to the receptacle, whereby the receptacle is pivoted between the open position wherein it is disposed at approximately right angles to the shaft, and the closed position relative to the closure wherein the receptacle is parallel with the shaft and beneath the closure, by manually sliding the sleeve on the shaft.

The shaft is of tubular construction and has a removable handle mounted on the upper end thereof, whereby a stick or similar element can be carried therein, whereby the pet droppings can be pushed into a disposable bag in the receptacle.

BRIEF DESCRIPTION OF THE DRAWINGS

FIG. 1 is a perspective view of the scoop of the present invention;

FIG. 2 is a side elevational view showing the scoop in the closed position;

FIG. 3 is a fragmentary, front elevational view showing the scoop in the open position;

FIG. 4 is fragmentary, sectional view showing the removable handle portion;

FIG. 5 is a view taken along 5—5 of FIG. 2;

FIG. 6 is a fragmentary, enlarged, side elevational view of the pivotal connection of the receptacle to the lower end of the shaft;

FIG. 7 is an enlarged fragmentary longitudinal section view showing the details of the linkage connection between the sleeve and receptacle.

DESCRIPTION OF THE PREFERRED EMBODIMENT

Figure 9:
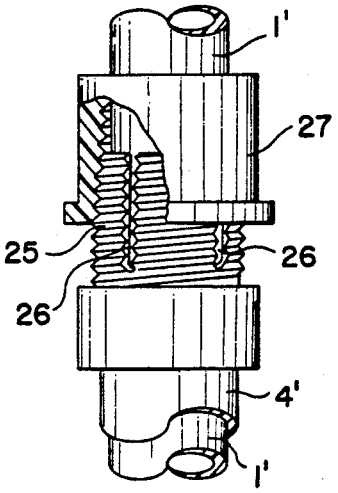
FIG. 9 is an enlarged, fragmentary side elevational view of a portion of FIG. 8.

Referring to the drawings and more particularly to FIGS. 1 and 2, the scoop of the present invention comprises a tubular shaft 1 having a receptacle 2 pivotally connected to the lower end portion thereof as at 3. A stationary closure or lid portion 5 is fixedly secured to the shaft 1 by bracket 6, the closure 5 being spaced above the top of receptacle 2. A sleeve 4 is slidably mounted on the shaft 1 and has an open longitudinal slot 22 in the lower end portion thereof for clearance of bracket 6.

A link 7 extends between the lower end of sleeve 4 and the receptacle 2 and has its upper end pivotally connected to the sleeve as at 8, and its lower end pivotally connected to the receptacle as at 9.

The details of the construction of the link 7 and its pivot connections 9 and 8 with the associated receptacle 2 and sleeve 4, respectively, are shown in FIG. 7, wherein it will be seen that the link 7 consists of a heavy gage steel wire bent inwardly at opposite ends and extending into suitable apertures provided in the sleeve 4 and the back wall of the receptacle 2 to thereby provide the respective pivotal connections 8 and 9. It will be noted that the pivotal connection 9 is offset from the pivotal connection 8 so that when the sleeve 4 is pushed downwardly the receptacle 2 will pivot about the pivotal connection 3 to the open position as shown in FIGS. 1 and 3. When the sleeve 4 is pulled upwardly, the receptacle will pivot in the opposite direction to the closed position as shown in FIG. 2. A slot 10 is provided in the wall of the tubular shaft 1 to accommodate the bent end of link 7 that forms the pivotal connection 8 during the reciprocatory movement of the sleeve 4.

In order to hold the receptacle 2 in a normally closed position, a cam portion 11 is provided on the outer surface of the tubular shaft for frictionally engaging the interior wall surface of the sleeve 4. When in the closed position, as shown in FIG. 2, there is a slight clearance 12 provided between the top edge of the receptacle 2 and the bottom surface of the closure 5 to prevent the possible soiling of the closure.

Referring to FIG. 4, it will be seen that the upper end portion of the tubular shaft 1 is provided with an enlarged mouth portion 13 for telescopically receiving a tubular shank portion 14 of a handle 15. When the handle shank portion 14 is inserted or socketed into the tubular shaft 1, a chamber or compartment is provided for carrying a stick 16 or similar element. By this construction and arrangement, the handle 15 can be removed from the upper end of the shaft 1, and the stick 16 manually removed therefrom and used to push the dog droppings in to the receptacle 2, as shown in FIG. 1, and then disposed of. A fresh stick can always be stored in the compartment for convenience.

The details of the construction of the pivotal connection 3 are shown in FIGS. 5 and 6, wherein it will be seen that the tubular shaft 1 and receptacle 2 are of molded plastic, the shaft having a pair of spaced bifurcated arms 17 integrally formed on the outer surface of the sidewall and extending outwardly therefrom. An arm 18 is integrally formed on the bottom edge of the receptacle 2 intermediate the side thereof and extending outwardly and downwardly therefrom. A transversely extending pin 19 is integrally formed on the depending end of the arm 18 and is adapted to be snapped into the bifurcated arms 17, to thereby provide a hinge.

To complete the structure of the scoop, a rubber foot or bumper 20 is mounted on the lower end of the shaft 1 to prevent wear on the lower end of the shaft since the dog owner can employ the scoop assembly as a cane while walking the dog when the scoop is in the normally closed position.

As will be seen in FIGS. 1 and 3, while the rear wall of the receptacle is flat, the front wall which engages the ground, when in the open position, is arcuate to facilitate the scooping of the droppings into the receptacle 2, and a disposable bag 21 is insertable into the receptacle 2 to prevent the interior of the receptacle from becoming soiled.

In using the scoop of the present invention, the dog owner will first place a disposable bag 21 in the receptacle 2 with the top edge of the bag pulled down over the outside top edge of the receptacle, and the receptacle is then moved to the closed position, as shown in FIG. 2, by sliding sleeve 4 upwardly relative to shaft 1. With the receptacle in the closed position, the dog owner can employ the scoop assembly as a walking cane while walking the dog. When it is necessary to remove a deposited dropping from the ground, the dog owner will hold the handle 15 or shaft 1 with one hand and push the sleeve 4 downwardly with the other hand, to thereby pivot the receptacle 2 to the open position as shown in FIG. 1. If it is necessary to push the droppings into the bag in the receptacle 2, the handle 15 and associated shank 14 can be pulled out of the upper end of the shaft 1 and the stick 16 removed therefrom. After the droppings have been pushed into the receptacle 2, the sleeve 4 is pulled upwardly, to thereby cause the receptacle to be pivoted to the closed position beneath the closure 5, so the droppings are out of sight, and the odor is also reduced by the spaced closure 5. Later, the bag 21 with the droppings therein is removed from receptacle 2 and disposed of.

From the above description it will be readily appreciated by those skilled in the art that the device of the present invention provides an improved scoop having an easily manipulatable receptacle 2 and closure 5 wherein the link 7 provides a positive connection for moving the receptacle 2 to the open and closed positions and which is not likely to get out of order even after long and continued use. Furthermore, the actuating components are remote from the ground, thus, preventing the soiling thereof.

A modified form of the scoop of the invention is shown in FIGS. 8, 9, 10, and 11, wherein like parts, with those described in the first form of the invention, are designated with corresponding primed reference numerals. The modified scoop is mechanically the same as the scoop described in the first form of the invention, and operates in the identical manner, but shows another form in which the scoop can be constructed of molded plastics material, and thus, all details of the construction will not be described, since it is believed to be unnecessary.

Figure 8:
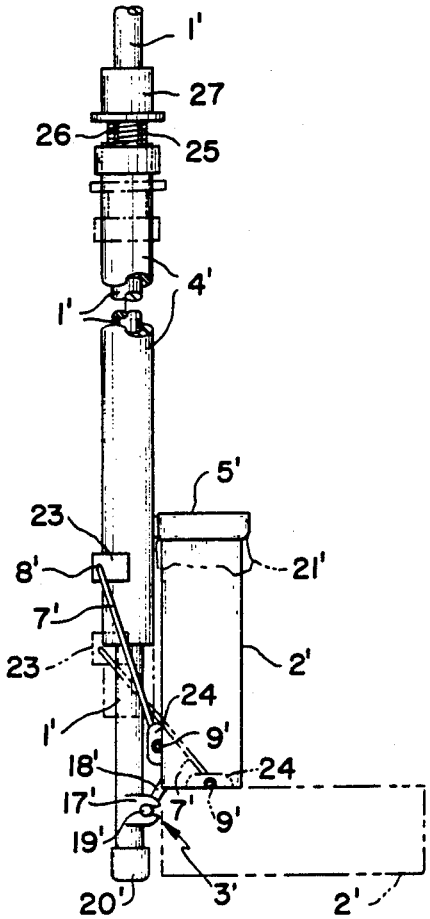
FIG. 8 is an enlarged, foreshortened side elevational view, similar to FIG. 2, showing a modified form of the scoop in the closed position, and in the open position in phantom.
Figure 10:
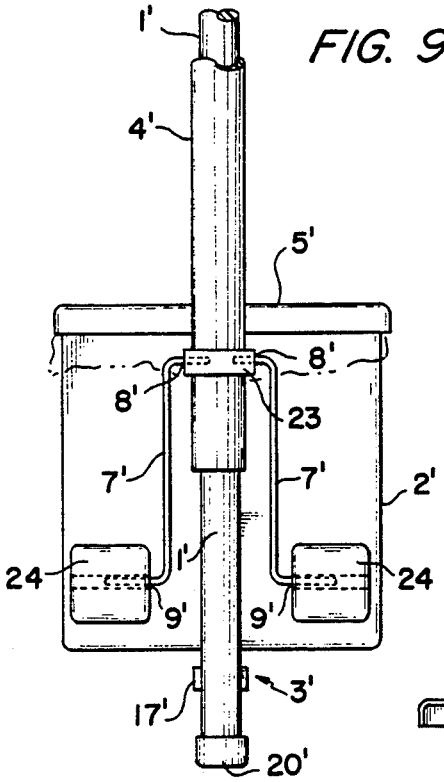
FIG. 10 is an enlarged rear elevational view of a fragmentary portion of FIG. 8.
Figure 11:
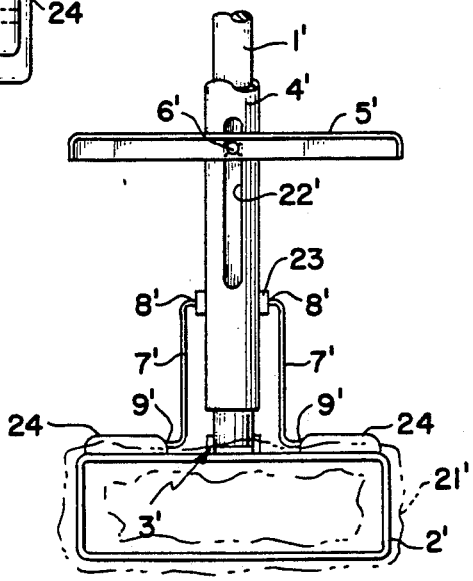
FIG. 11 is an enlarged, fragmentary, front elevational view of the scoop of FIG. 8 in the open position.

In the modified scoop structure, receptacle 2' is rectangular and has a rectangular open top end with a flat front wall portion which engages the ground when the receptacle is in the open position, as shown in FIG. 11, and in phantom lines in FIG. 8. The lower end of receptacle 2' is pivotally connected to the lower end portion of shaft 1' with pivot connection structure 3', 17', 18', 19' of the same type as in the prior form. Stationary closure or lid 5' is connected to shaft 1' above the top opening of receptacle 2' in slightly spaced relation with the connector 6' extending through longitudinal slot 22' in sleeve 4' that is slidably mounted in co-axial relation with and for longitudinal movement on shaft 1'. In this form of the invention, longitudinal slot 22' is in a medial portion of sleeve 4' and does not extend to the lower edge of the sleeve as in the prior form.

A boss 23 is formed on sleeve 4' adjacent the lower end thereof, and in the vicinity of the lower end of slot 22'.

Instead of a single link 7, as in the prior form of the scoop, a pair of links 7', of heavy gage steel wire, have their upper and lower ends bent at substantially right angles thereto and in opposite directions, with the top ends pivotally connected at 8' to boss 23 on opposite sides of sleeve 4', and the lower ends, which extend in opposite directions to the upper ends, pivotally connected at 9' in apertures in protrusions 24 on the back wall of receptacle 2'. Since pivotal connections 9' are offset from the pivotal connections 8', when sleeve 4' is pushed downwardly, as indicated in phantom lines in FIG. 8, receptacle 2' is pivoted about the pivotal connection 3' from its closed position with the open top end beneath closure 5' wherein the longitudinal axis of receptacle 2' is parallel with the longitudinal axes of shaft 1' and sleeve 4', to the open position, as shown in phantom lines, wherein the longitudinal axis of receptacle 2' is at right angles to the longitudinal axes of shaft 1' and sleeve 4', and the open top end of the receptacle is facing away from the shaft. The pivotal connections 9' are spaced above pivotal connection 3'. It will also be noted that in this form of the invention, the pivotal connections 8' and 9' are offset to a greater extent from each other, since they are positioned completely on opposite sides of sleeve 4', thus increasing the efficiency of the pivotal movement of receptacle 2' from its upward closed position to its downward open position at right angles thereto upon downward sliding movement of sleeve 4' relative to shaft 1'.

To hold receptacle 2' in its normally closed upward position, wherein the open end of the receptacle is beneath closure 5', the upper end of sleeve 4' is externally threaded as at 25 and is provided with plural longitudinal slots 26 in the area of the threads and extending downwardly from the upper end from sleeve 4'. A mating tapered internally threaded nut 27 having an open top end, and surrounding shaft 1', threadably engages threads 25 on the upper end of sleeve 4'. When the user slides sleeve 4' upwardly on shaft 1' to move receptacle 2' to the closed position, while holding sleeve 4' with one hand, the user rotates nut 27 with the other hand to thread it downwardly onto the end of sleeve 4'. The tapered nut 27, in conjunction with longitudinal slots 26, flex the threaded portion 25 inwardly, so that the inner bore portion thereof is moved into frictional engagement with the outer circumference of shaft 1' to thus frictionally lock sleeve 4' and receptacle 2' in the upper closed position. To move the receptacle to the open position, the nut 27 is rotated in the opposite direction to frictionally release sleeve 4' from engagement with shaft 1', so it can be slid downwardly on shaft 1'.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A scoop for removing animal droppings from the ground comprising, a shaft having an upper end portion and a lower end portion, a receptacle having an open top end and a closed lower end, means pivotally connecting the lower end of said receptacle to the lower end portion of said shaft, a closure, connecting means fixedly mounting said closure on said shaft above the open top end of said receptacle, a sleeve slidably mounted on said shaft and having a lower portion extending below said connecting means for said closure, a slot in the lower portion of said sleeve, said connecting means for said closure extending through said slot whereby said sleeve is slidable on said shaft and between said shaft and said closure, and linkage means operatively connected between the sleeve and the receptacle, whereby the receptacle is pivoted downwardly away from said closure to an open position when the sleeve is moved downwardly on said shaft, and pivoted upwardly to a closed position adjacent the closure when the sleeve is moved upwardly on the shaft.

2. A scoop according to claim 1, wherein the means pivotally connecting the receptacle to the shaft comprises a pair of spaced bifurcated arms integrally connected to the shaft and extending outwardly therefrom, and a transversely extending pin connected to the bottom edge of the receptacle, the pin being snapped into the bifurcated arms to thereby provide a hinge between the shaft and the receptacle.

3. A scoop according to claim 1, wherein the linkage means comprises a heavy gage steel wire, one end of the wire being pivotally connected to the lower end portion of the sleeve, and the opposite end portion of the wire being pivotally connected to the receptacle.

4. A scoop according to claim 3, wherein the pivotal connection of the wire to the receptacle is offset from the pivotal connection of the wire to the sleeve.

5. A scoop according to claim 4, wherein the wire is bent inwardly at each end thereof and connected to the sleeve and receptacle to form the respective pivotal connections.

6. A scoop according to claim 1, wherein handle means is removably mounted on the upper end of said shaft, said handle means cooperating with said shaft to form a chamber, a removable element contained in said chamber, whereby the element can be employed for pushing the animal droppings into the receptacle.

7. A scoop according to claim 1, wherein a disposable bag is mounted in said receptacle.

8. A scoop according to claim 1, wherein the receptacle is formed with a flat back wall to which the means pivotally connecting the receptacle to the shaft is connected, and a flat front wall portion for engaging the ground when said receptacle is in the open position.

9. A scoop according to claim 1, wherein said means pivotally connecting the receptacle to said shaft comprises pin receiving means and a transverse pin pivotally received in said pin receiving means connected between said shaft and said receptacle, to thereby provide a hinge between said shaft and said receptacle.

10. A scoop according to claim 1, wherein said linkage means comprises a pair of links on opposite sides of said shaft, one end of each link of said pair being pivotally connected to the lower end portion of said sleeve, and the opposite end of each link of said pair being pivotally connected to said receptacle.

11. A scoop according to claim 10, in which the opposite ends of each link of said pair of links extend in opposite directions therefrom and are connected to said sleeve and receptacle to form the respective pivotal connections.

12. A scoop according to claim 1, wherein the connection of said linkage means to said receptacle is spaced above said means pivotally connecting said receptacle to the lower end portion of said shaft.

13. A scoop according to claim 1, in which said receptacle has a back wall, protrusion means on said back wall, and said linkage means having one end pivotally connected to said protrusion means.

14. A scoop for removing animal droppings from the ground comprising, a shaft having an upper end portion and a lower end portion, a receptacle, means pivotally connecting said receptacle to the lower end portion of said shaft, a closure fixedly mounted on said shaft, a sleeve slidably mounted on said shaft, a heavy gage steel wire having one end bent inwardly and pivotally connected to the lower end portion of said sleeve, said wire having an opposite end bent inwardly and pivotally connected to the receptacle, the pivotal connection of said wire to said receptacle is offset from the pivotal connection of said wire to said sleeve, and a slot provided in the lower end portion of said shaft to accommodate the pivotal connection of said wire to said sleeve, whereby the receptacle is pivoted downwardly away from said closure to an open position when the sleeve is moved downwardly on said shaft, and pivoted upwardly to a closed position adjacent the closure when the sleeve is moved upwardly on the shaft.

15. A scoop for removing animal droppings from the ground comprising, a shaft having an upper end portion and a lower end portion, a receptacle, means pivotally connecting said receptacle to the lower end portion of said shaft, a closure fixedly mounted on said shaft, a sleeve slidably mounted on said shaft, linkage means operatively connected between the sleeve and the receptacle, whereby the receptacle is pivoted downwardly away from said closure to an open position when the sleeve is moved downwardly on said shaft, and pivoted upwardly to a closed position adjacent the closure when the sleeve is moved upwardly on the shaft, and cam means provided on the outer surface of said shaft engaging the inner surface of said sleeve to frictionally hold said sleeve, whereby the receptacle is normally held in a closed position.

16. A scoop for removing animal droppings from the ground comprising, a shaft having an upper end portion and a lower end portion, a receptacle, means pivotally connecting said receptacle to the lower end portion of said shaft, a closure fixedly mounted on said shaft, a sleeve slidably mounted on said shaft, said sleeve having a split threaded upper end portion, a mating nut member co-axial with said shaft and threadably engaging said split threaded upper end portion, and linkage means operatively connected between the sleeve and the receptacle, whereby the receptacle is pivoted downwardly away from said closure to an open position when the sleeve is moved downwardly on said shaft, and pivoted upwardly to a closed position adjacent the closure when the sleeve is moved upwardly on the shaft, and tightening said nut member on said split threaded upper end portion locks said sleeve on said shaft from movement relative thereto.

17. A scoop according to claim 16, in which said nut member is an internally threaded tapered nut member.

* * * * *